US009222489B2

(12) United States Patent
Stoddard et al.

(10) Patent No.: US 9,222,489 B2
(45) Date of Patent: Dec. 29, 2015

(54) TWO-STEP HYDRAULIC VALVE

(75) Inventors: Kenneth John Stoddard, Santaquin, UT (US); Cameron Snow Andersen, Spanish Fork, UT (US); Garth L Mason, Springville, UT (US); Jared M. Mangum, Highland, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 544 days.

(21) Appl. No.: 13/532,783

(22) Filed: Jun. 26, 2012

(65) Prior Publication Data

US 2013/0343939 A1 Dec. 26, 2013

(51) Int. Cl.

| | |
|---|---|
| ***F04B 53/10*** | (2006.01) |
| ***F15B 9/08*** | (2006.01) |
| ***F04B 9/105*** | (2006.01) |
| ***F15B 15/14*** | (2006.01) |
| ***F15B 15/20*** | (2006.01) |

(52) U.S. Cl.

CPC . *F15B 9/08* (2013.01); *F04B 9/105* (2013.01); *F04B 9/1056* (2013.01); *F04B 53/10* (2013.01); *F15B 15/1476* (2013.01); *F15B 15/204* (2013.01); *Y10T 137/8663* (2015.04)

(58) Field of Classification Search

CPC ..... F04B 9/08; F04B 9/10–9/1095; F04B 9/111–9/1178; F04B 53/10; F15B 15/1476; F15B 15/204; Y10T 137/8663

USPC ..... 417/375–404; 91/47–51, 218–354; 137/625.6, 625.63, 625.66

See application file for complete search history.

(56) References Cited

U.S. PATENT DOCUMENTS

| | | | | |
|---|---|---|---|---|
| 2,087,713 | A * | 7/1937 | Whiteside et al. | 91/313 |
| 3,304,126 | A * | 2/1967 | Rupp et al. | 406/96 |
| 3,368,458 | A * | 2/1968 | Shinaver | 91/308 |
| 3,685,395 | A * | 8/1972 | Straub et al. | 91/216 B |
| 4,649,956 | A | 3/1987 | Zeuner et al. | |
| 5,893,707 | A | 4/1999 | Simmons et al. | |
| 6,889,765 | B1 | 5/2005 | Traylor | |
| 7,252,148 | B2 | 8/2007 | Traylor | |
| 8,079,831 | B2 | 12/2011 | Stoddard | |
| 2004/0188096 | A1 | 9/2004 | Traylor | |
| 2005/0142005 | A1 | 6/2005 | Traylor | |
| 2006/0008364 | A1 | 1/2006 | Traylor | |
| 2007/0092385 | A1* | 4/2007 | Petrie Pe | 417/395 |
| 2007/0110597 | A1 | 5/2007 | Traylor | |
| 2008/0003118 | A1 | 1/2008 | Traylor | |
| 2010/0272587 | A1 | 10/2010 | Stoddard | |
| 2011/0030547 | A1 | 2/2011 | Depiak et al. | |

OTHER PUBLICATIONS

Examination Report issued in AU2013206498 on Feb. 12, 2015, 3 pages.

* cited by examiner

*Primary Examiner* — Peter J Bertheaud
*Assistant Examiner* — Dnyanesh Kasture
(74) *Attorney, Agent, or Firm* — Michael Stonebrook

(57) ABSTRACT

A two-step hydraulic valve is described. In an implementation, a two-step hydraulic valve with retrograde spool action has a pilot spool that controls hydraulic force applied to a main spool to switch a rod of a hydraulic actuator back-and-forth between extension and retraction. The main spool is hydraulically driven in retrograde motion to the pilot spool, providing improved reliability and switching action for the valve. The pilot spool also has an overtravel feature that can be used to hyperextend the rod for various purposes. In an example system, the two-step hydraulic valve controls a hydraulic actuator connected to drive a submersible reciprocating pump, such as a diaphragm pump.

18 Claims, 13 Drawing Sheets

TWO-STEP HYDRAULIC VALVE

BACKGROUND

Reciprocating hydraulic cylinders can provide power to drive some types of submersible pumps. In certain wells, such as coal bed methane and other oil and gas shallow wells, a reciprocating pump may be used to provide artificial lift to remove water from the wellbore or to pump hydrocarbons through production tubing. The reciprocating pump can be a positive-displacement single-acting diaphragm pump. Such reciprocating pumps may be driven by a reciprocating hydraulic cylinder, powered by hydraulic fluid from a surface unit. The reciprocating hydraulic cylinder may use a mechanical valve arrangement to switch stroke directions back-and-forth between extension and retraction of the hydraulic cylinder rod without having to vary or switch the pressure and flow direction of the incoming hydraulic fluid being supplied from the surface.

SUMMARY

A two-step hydraulic valve is described. In an implementation, a two-step hydraulic valve with retrograde spool action controls a hydraulic actuator connected to drive a submersible reciprocating pump. The example system includes the two-step hydraulic valve and a hydraulic cylinder including a rod that can be extended and retracted. The two-step hydraulic valve has a pilot spool that controls hydraulic force applied to a main spool to switch the rod back-and-forth between extension and retraction. The main spool is hydraulically driven in retrograde motion to the pilot spool, providing improved reliability and switching action for the valve. The pilot spool also has an overtravel feature that can be used to hyperextend the rod for various purposes. This summary section is not intended to give a full description of two-step hydraulic valves. A detailed description with example embodiments follows.

DETAILED DESCRIPTION

Figure 1:
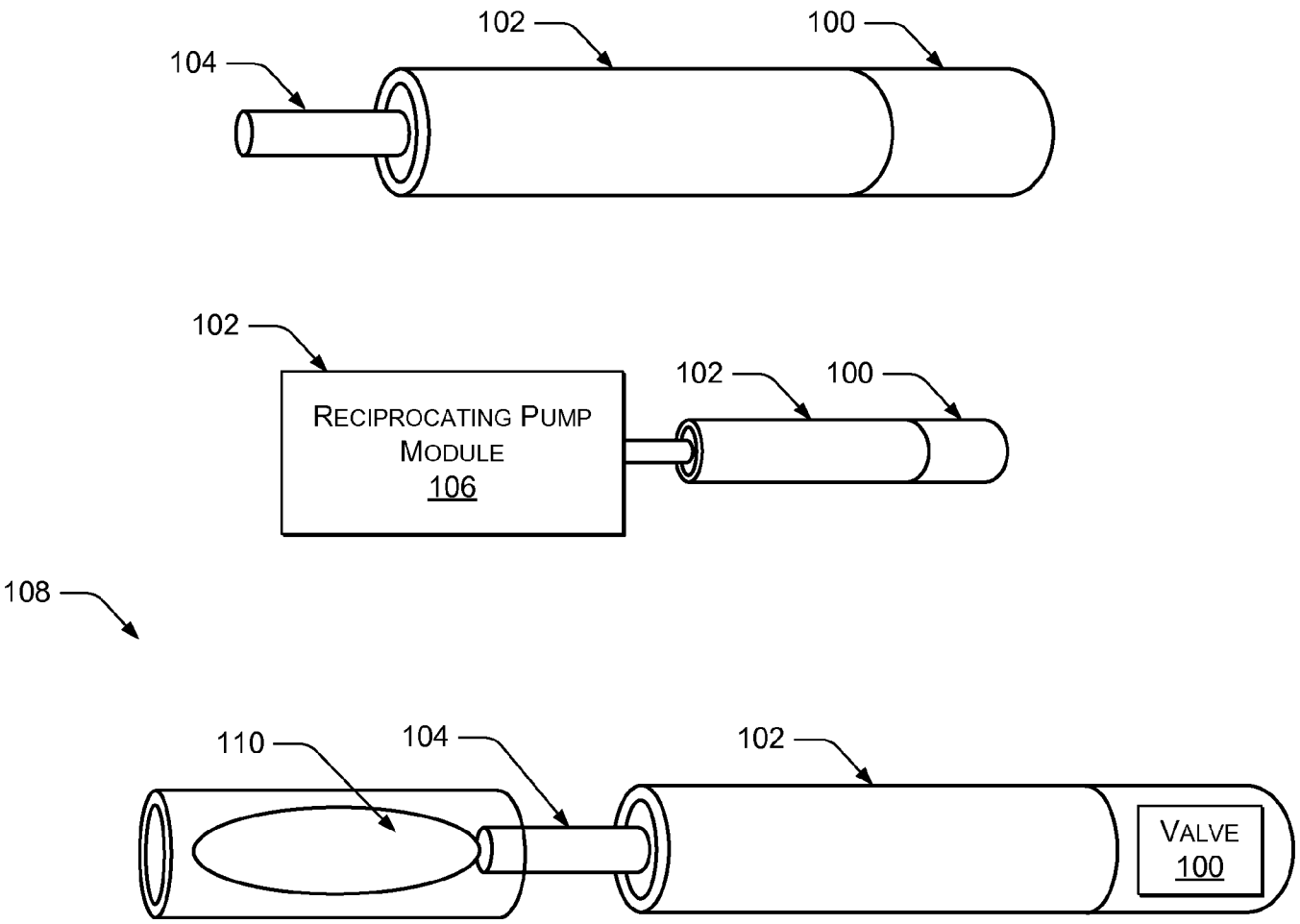
FIG. 1 is a diagram of example applications for an example two-step hydraulic valve with retrograde spool action.

This disclosure describes two-step hydraulic valves. As shown in FIG. 1, an example two-step valve 100 has retrograde spool action to provide improved switching action and reliability and can be used in various applications. In one application, the valve 100 regulates a hydraulic actuator 102, such as a hydraulic cylinder, in order to reciprocate a rod 104. Thus, the valve 100 can switch generic self-actuating reciprocating hydraulic cylinders. A hydraulic actuator 102 as controlled by the valve 100 may power a reciprocating pump 106 for moving water, hydrocarbons, or other fluids in oil and gas wells. The valve 100 reverses the direction of travel of a piston rod 104 at the end of each extension or retraction stroke, by directing hydraulic fluid to different sides of a hydraulic piston, using a center feed rod to supply the hydraulic fluid to the bottom, or far side, of the hydraulic piston. In an implementation, a pump 108 that is insertable into wells has an integrated two-step valve 100 that hydraulically actuates the filling and emptying of a diaphragm 110. In each application, the two-step hydraulic valve with retrograde spool action 100 provides high-reliability cycling and long life to reciprocating pumps 106 and other reciprocating applications.

In an implementation, the example two-step valve 100 provides improvements over conventional one-step and two-step valves. A conventional one-step valve uses springs and a détente to fire the main spool of the one-step valve to a new state. A conventional two-step valve uses ports on a pilot spool to move a main spool to a new state, opening and closing appropriate ports. Such a conventional two-step valve is described in U.S. Patent Publication 2010/0272587 to Stoddard, entitled, "Submersible Pump Having A Two-Step Control Hydraulic Valve," which is incorporated herein by reference in its entirety. The motion of the main spool on a conventional two-step valve is in the same direction as the pilot spool.

Figure 2:
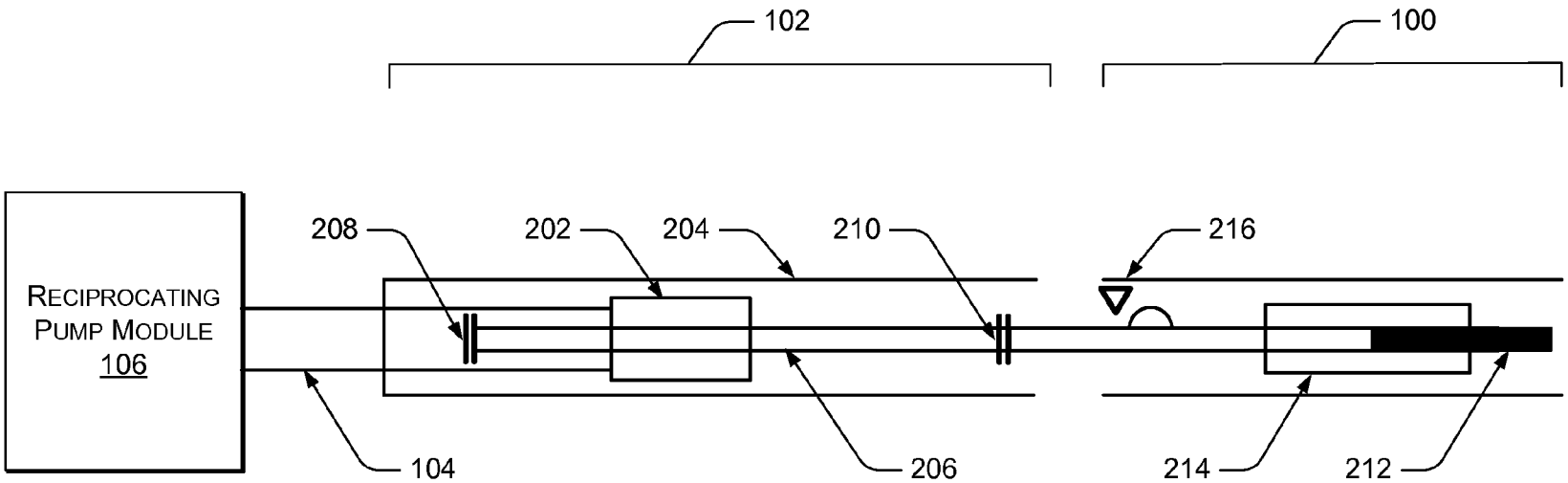
FIG. 2 is a diagram of example components associated with an example two-step hydraulic valve when used in a reciprocating pump application.

FIG. 2 shows an example layout of components associated with an example two-step hydraulic valve with retrograde spool action 100 when used to control a hydraulic actuator 102, which in turn drives a reciprocating pump module 106 (e.g., submersed in a well). In the hydraulic actuator 102, a piston 202 slides in a hydraulic barrel 204. The piston 202 is connected to a piston rod 104 which drives the reciprocating pump module 106. A center feed rod 206 supplies pressured hydraulic fluid from a powered hydraulic pump and reservoir on the surface (hydraulic supply line and hydraulic return line, connected far right, not shown in FIG. 2). In an extension stroke of the piston rod 104, hydraulic fluid is supplied to a first side of the piston 202, while in a return stroke, hydraulic fluid is supplied via the center feed rod 206 to the far side of the piston 202.

In an implementation, the piston 202 has no mechanical stops, but does contact center rod stops 208 & 210 at some point in each stroke. The center rod stops 208 & 210 do not stop the piston 202 but rather move the center feed rod 206. The center feed rod 206, however, is mechanically connected to the pilot spool 212 of the valve 100. When the piston 202 has contacted one of the center rod stops 208 or 210 and has moved the center feed rod only a short distance, such as 0.4 inches, the connected pilot spool 212 also moves with the center feed rod 206 and transitions to a next porting state. A porting state is a valve state in which certain hydraulic fluid ports of the valve 100 are open and certain hydraulic fluid ports of the valve 100 are closed. The pilot spool 212 is moved by the movement of the center feed rod 206 to open a port controlling the main spool 214 of the valve 100. The main spool 214 moves in a direction opposite or "retrograde" to the movement of the pilot spool 212, providing definitive switching action, like a snap-action, and in doing so, the main spool 214 also moves to a next porting state, which controls the hydraulic fluid to the piston 202, hydraulically reversing the direction of the piston 202 (without imposing a mechanical stop). The center feed rod 206 and connected pilot spool 212, once contacted by the piston 202 at one of the stops 208 or 210, may slide of their own accord, i.e., by their own momentum. In some implementations, these short motions of the center feed rod 206 are regulated with a physical détente attached to the pilot spool 212 or to the center feed rod 206 itself. Thus, the piston 202 cycles back-and-forth, actuating a movement of the pilot spool 212 at the end of each stroke (or more correctly, actuating a movement of the pilot spool 212, which then causes the end of each stroke).

Figure 3:
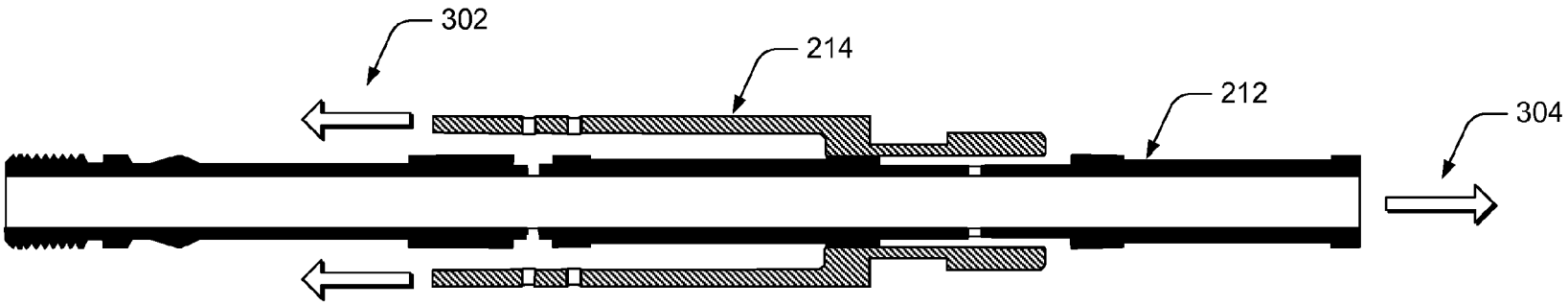
FIG. 3 is a diagram of example retrograde motion of a main spool with respect to a pilot spool in an example two-step hydraulic valve.

As shown in FIG. 3, the example two-step valve 100 inverts the conventional relative motion between the main spool 214 and the pilot spool 212 (of a conventional two-step valve such as that described in the Stoddard reference, above), so that during at least some parts of the reciprocation cycle, the main spool 214 moves retrograde 302, under positive hydraulic pressure, to the movement 304 of the pilot spool 212, thereby increasing the snap characteristic of the valve 100 and imparting increased reliability and power to the valve's switching action between rod extension and rod retraction.

Once control ports of the pilot spool 212 apply pressured hydraulic fluid to the main spool 214, and also cause output ports to open to relieve hydraulic fluid holding the main spool in a given state, the main spool 214 is then hydraulically moved in the opposite direction (with respect to the pilot spool 212) to the next porting state, and held there hydraulically. The advantage of this arrangement is increased reliability and a significantly increased snap of the switching action of the valve 100. After the main spool 214 moves to a new state it is hydraulically locked there and the pilot spool 212 must be moved a significant distance in the opposite direction before the main spool 214 can change states again.

Thus, the example two-step valve 100 inverts the conventional direction of motion of a main spool 214 to increase the robustness of the action and responsiveness of the valve 100. The inverted response of the main spool 214 to actuation by the pilot spool 212 is like a snap action, in which the main spool 214 changes state definitively upon a very small actuation by the pilot spool 212, such as a small movement or a small opening of a relevant port by the pilot spool 212. The retrograde motion of the main spool 214 in response to actuation by the pilot spool 212 increases the power, speed, reliability, and finality of the valve's switching action from one valve state to another valve state. In an implementation, the pilot spool 212 hydraulically drives the main spool 214 so that the main spool 214 is quickly transitioned to each next porting state by force of hydraulic pressure in a motion retrograde to the motion of the pilot spool 212. This results in a sudden, strong or "overwhelming" thrust on the main spool 214, forcing the main spool 214 to quickly switch to the other porting position, where the main spool 214 is then held immobilized by the applied hydraulic pressure and/or hydraulic fluid occupying closed spaces preventing movement, until the next time the pilot spool 212 changes the hydraulic flow to the main spool 214. The new porting position of the main spool 214, in turn, hydraulically stops and hydraulically reverses the piston 202 of the hydraulic actuator 102, which in some implementations also reinforces a separate snap-action of the pilot spool 212 as it clears a physical détente 216.

Figure 4:
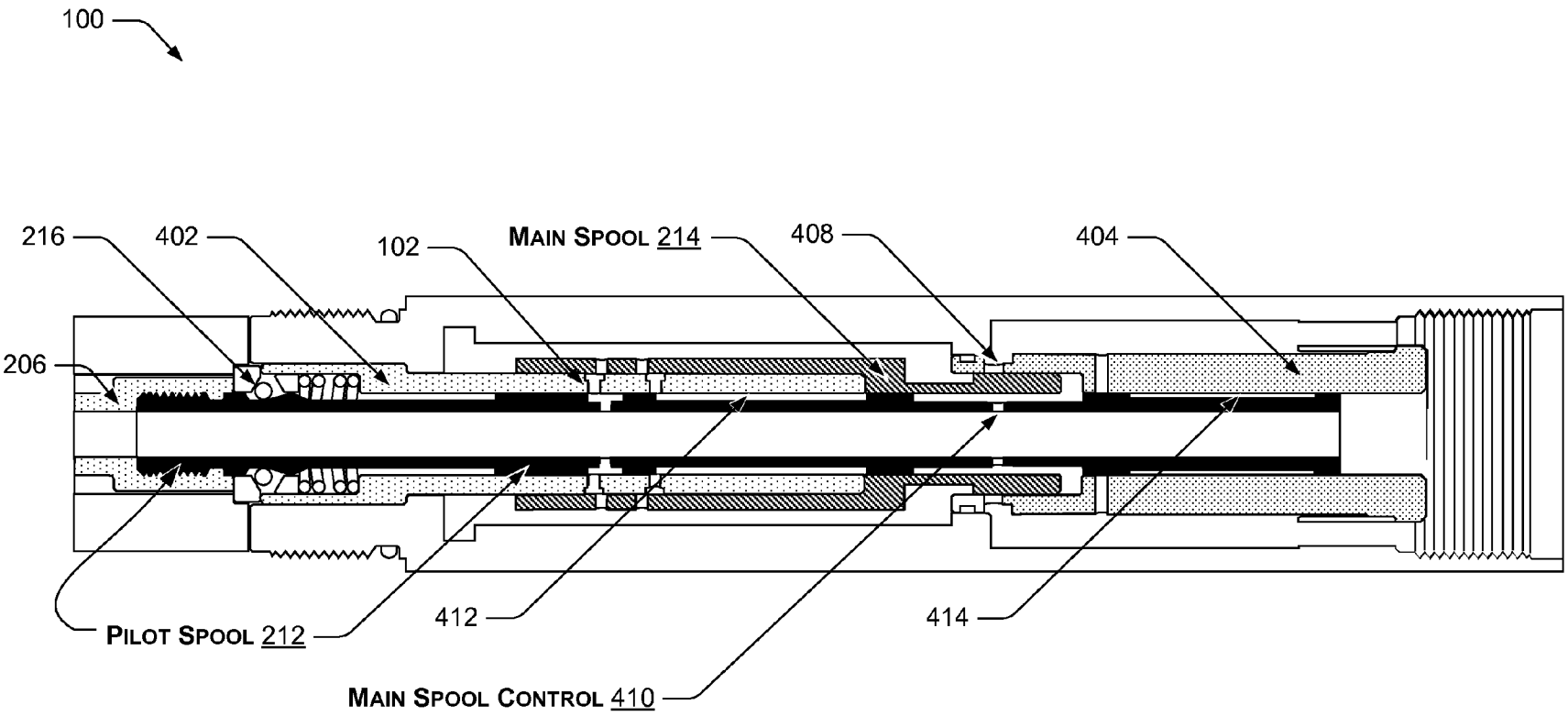
FIG. 4 is a diagram of components of an example two-step hydraulic valve with retrograde spool action.

FIG. 4 shows an example configuration of the two-step hydraulic valve 100. The center feed rod 206 is mechanically attached to the pilot spool 212. Movement of the center feed rod 206 and connected pilot spool 212 as an assembly, may be regulated by a physical détente 216, such as a cam wedge on the pilot spool 212 and a ring of sequestered or spring-pressured balls around the outside diameter of the pilot spool 212, for example thirteen balls.

The main spool 214 slides axially along the pilot spool 212 and also along an extend cartridge 402 and a retract cartridge 404. In FIG. 4, the extend cartridge 402 and the retract cartridge 404 are stationary. Each of these components, the pilot spool 212, the main spool 214, the extend cartridge 402, and the retract cartridge 404, have apertures, indents, and/or lands that constitute the hydraulic ports of the valve and determine the porting states of the valve as the valve components slide with respect to each other. These ports are placed so that as the components slide in a valve cycle, the opening and closing of ports are timed and sequenced to properly control the hydraulic hardware.

An extend port 406 in the extend cartridge 402 enables hydraulic fluid to extend the piston 202 and rod 104. A retract port 408 in the retract cartridge 404 enables retraction, and opens when the extend port 406 has been closed. A main spool control port 410 in the pilot spool 212 controls the porting state of the main spool 214, forcing the main spool 214 one way or the other, depending upon relative current positions of the sliding components and their ports. A bottom main spool vent 412 that used a land in the outside diameter of the pilot spool 212 releases the hydraulic fluid from a closed space holding the main spool 214 in an extend porting position, when position of the pilot spool 212 cracks open hydraulic access to the bottom main spool vent 412. Likewise, a top main vent 414 that also uses a different land in the outside diameter of the pilot spool 212 releases the hydraulic fluid from a closed space holding the main spool 214 in a retract porting position, when position of the pilot spool 212 cracks open hydraulic access to the top main vent 414.

FIGS. 5-21 show an example sequence of operations for an implementation of the two-step hydraulic valve with retrograde spool action 100. That is, FIGS. 5-21 show an example valve cycle.

Figure 5:
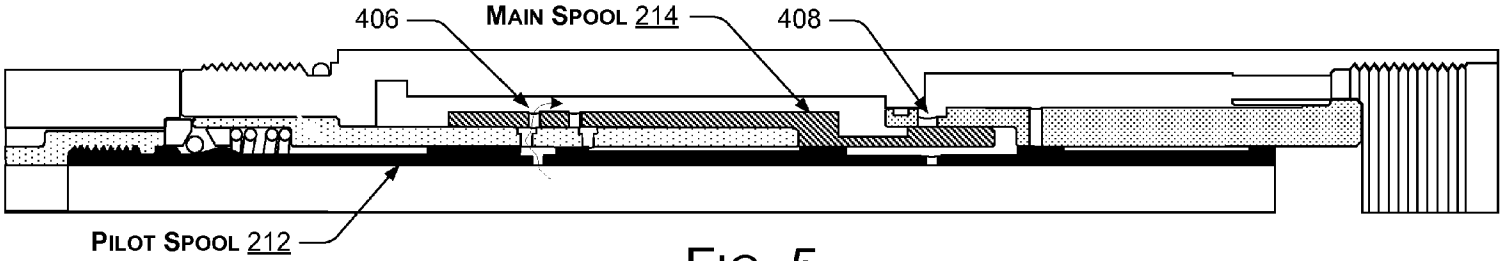
FIGS. 5-21 are diagrams showing an example sequence of operations during a valve cycle of an example two-step hydraulic valve with retrograde spool action.

FIG. 5 shows the example two-step hydraulic valve 100 in an extend mode. The extend port 406 is open, sending hydraulic fluid to the top of the piston 202 (not shown in FIG. 5). The retract port 408 is closed. Hydraulic pressure has previously forced the main spool 214 to the left in FIG. 5. Hydraulic fluid in the closed spaces around the main spool 214 also holds the main spool in the extend porting position. No return path or return line for hydraulic fluid to return to the hydraulic power source (e.g., on the surface) is currently open, instead the pressured hydraulic fluid is ported to do the work of extending the piston 202 and piston rod 104.

Figure 6:
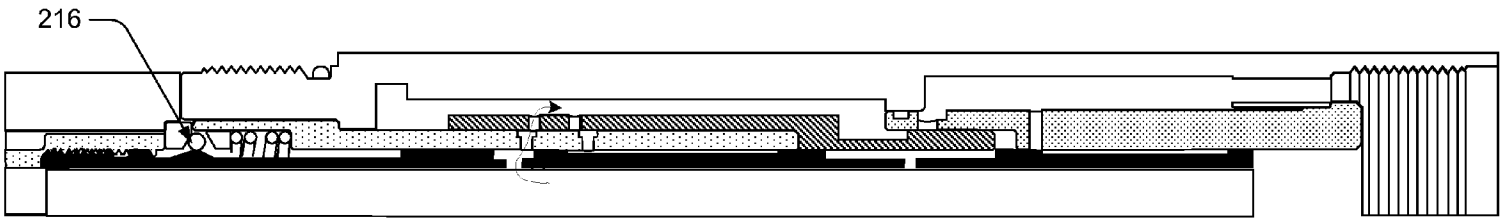

FIG. 6 shows a physical détente 216 at top dead center as the pilot spool 212 and the center feed rod 206 traverse to the left in FIG. 6. The flow path is unchanged. During extension, the piston 202 has contacted a center rod stop 208 on the center feed rod 206 and has started moving the center feed rod 206 and the pilot spool 212 to the left in FIG. 6, thus starting a switching process that will end the extension stroke.

Figure 7:
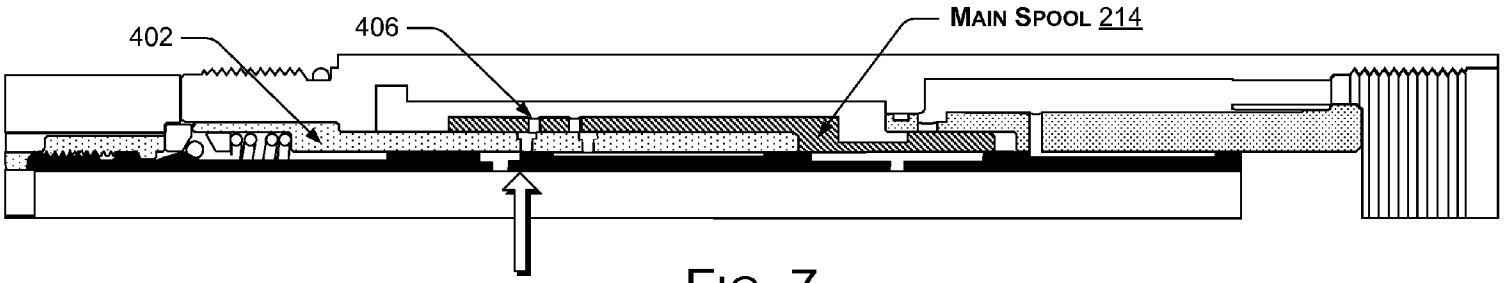

FIG. 7 shows the pilot spool 212 moving to the left and closing the extend port 406, i.e., the pilot spool 212-to-extend cartridge 402 interface is closed. The closed extend port 406 hydraulically stops the piston 202, not only because hydraulic pressure is no longer being applied to the piston 202, but also because the former hydraulic path for the extend mode has become a closed space filled with hydraulic fluid, which the piston 202 cannot pull against.

Figure 8:
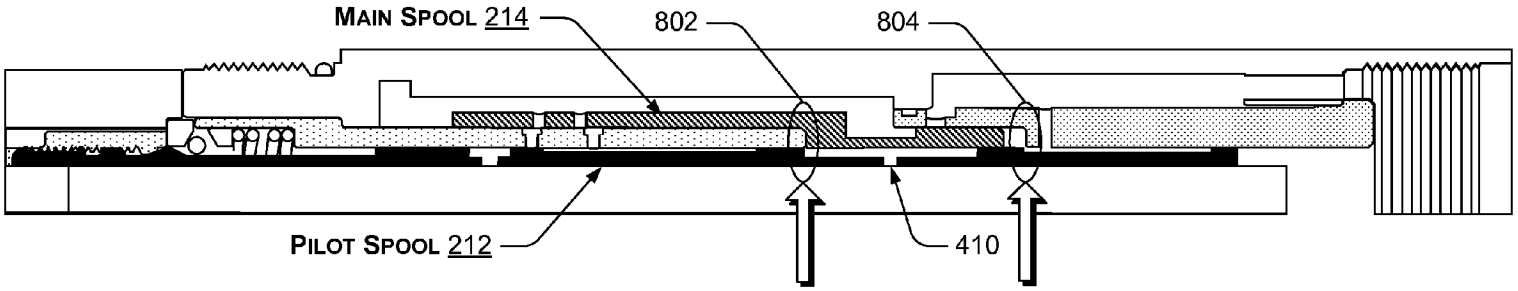

FIG. 8 shows alignment 802 of pilot spool 212 and main spool 214 that enables hydraulic pressure from the main spool control port 410 to be applied to the main spool 214 at a place effective for moving the main spool 214. At the same time, the top main vent 414 opens 804 providing a path for the hydraulic fluid that was holding the main spool 214 in place to leave the closed space.

Figure 9:
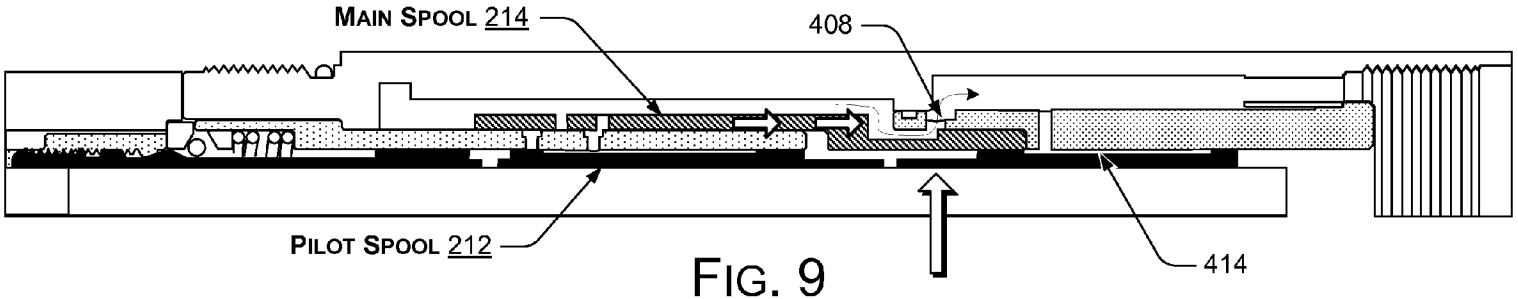

FIG. 9 shows the main spool 214 transitioned to a retract porting state. The main spool 214 has moved to the right in FIG. 9 because of the manner that hydraulic fluid is being applied (see FIG. 8) and vented by the position of the pilot spool 212. The main spool 214 is moved only by hydraulic pressure, there is no mechanical push from the pilot spool 212. The main spool 214 has moved to the right retroactively from the motion of the pilot spool 212, which is still moving to the left. Because the spools are moving in opposite directions, the relative speed of the main spool 214 with respect to the pilot spool 212 is higher than if the two spools were moving in the same direction. This high relative speed of the main spool transition results in improved switching of the valve 100. The retract port 408 is now open, flowing pressured hydraulic fluid, via the center feed rod 206, to the far side of the piston 202. The top main vent 414 is open providing a return path for hydraulic fluid back to the hydraulic supply.

Figure 10:
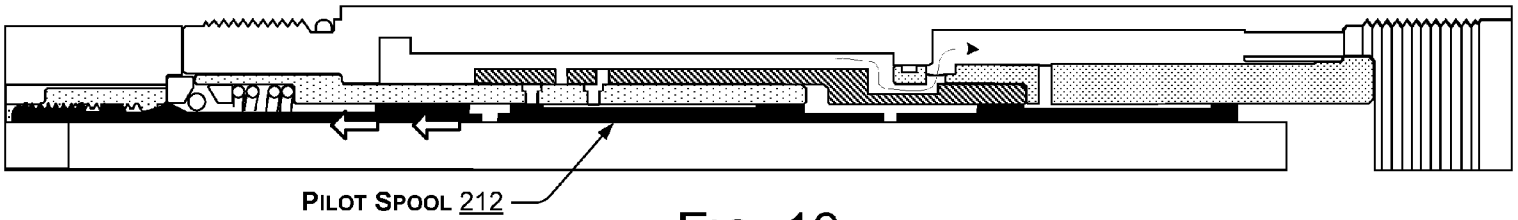

FIG. 10 shows overtravel of the pilot spool 212 as the pilot spool 212 continues moving to the left by its own momentum and that of the center feed rod 206. By closing the return hydraulic line connected to the entire hydraulic actuator 102 or to the valve 100, the piston 202 travels to its hydraulic extend limit. Because the return path is closed, the pressure on the top of the piston 202 does not drop so the piston rod assembly 104 does not retract. Leakage across the pilot spool 212 and the main spool 214 then enters the top of the piston 202, forcing the piston rod 104 down to its mechanical extension limit, finally resting on the center feed rod stop 208. The piston 202 overextends its normal extend stroke, instead of retracting. This hyperextension can be useful to perform certain functions.

Figure 11:
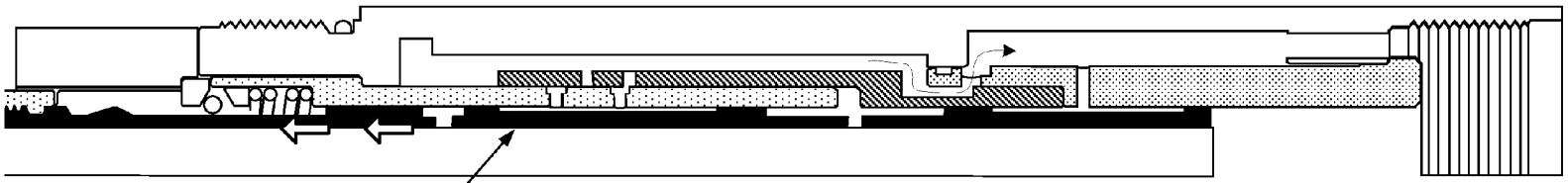

FIG. 11 shows continued overtravel of the pilot spool 212. In one implementation, the center feed rod 206 and connected pilot spool 212 still have approximately one inch to over travel under momentum before hitting a hard physical stop. There is no hydraulic pressure driving the motion of the pilot spool 212, the movement of the pilot spool 212 follows the movement of the center feed rod 206, which in turn is moved by brief encounters between the center rod stops 208 & 210 and the piston 202 near the end of each extend stroke and each retract stroke.

Figure 12:
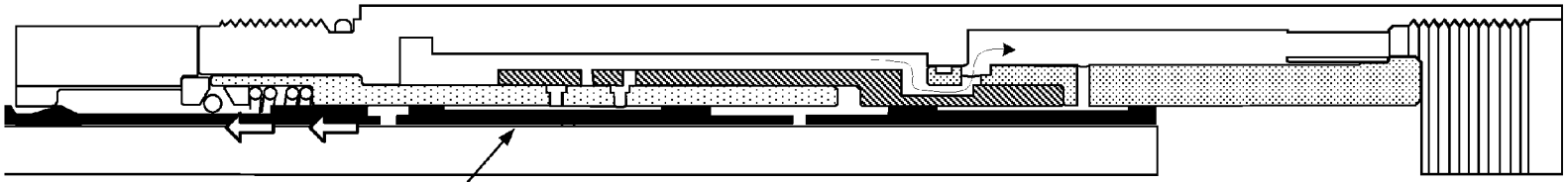

FIG. 12 shows continued overtravel of the pilot spool 212 (to the left in FIG. 12). If the overtravel condition is exploited by reversing the supply lines, then the piston 202 and piston rod 104 are still hyperextending.

Figure 13:
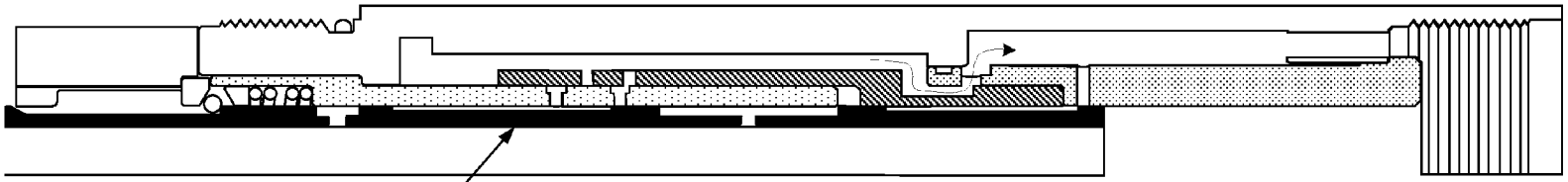

FIG. 13 shows the end of the pilot spool overtravel. The limit of the pilot spool overtravel is reached when the center feed rod 206 hits a mechanical stop. Depending on implementation, the center rod stop 208 can hit a limit, or a cam on the pilot spool can hit a limit, such as the détente 216.

Figure 14:
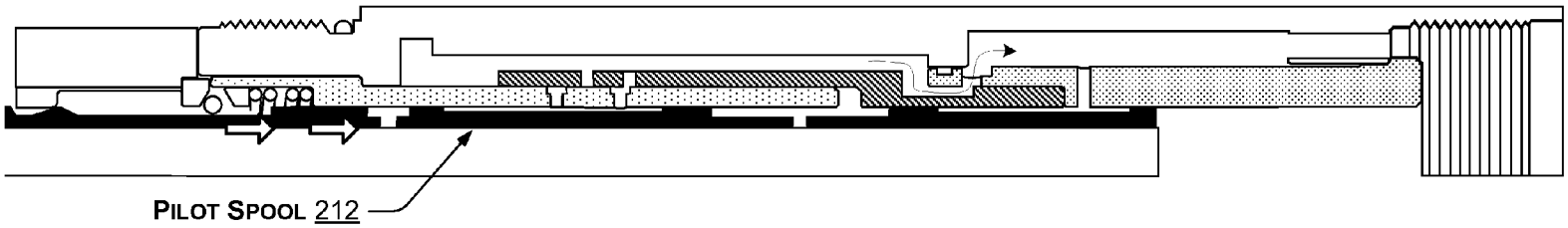

FIG. 14 shows the pilot spool 212 commencing movement in the opposite direction from the direction it was previously overtraveling before the attached center feed rod 206 hit a mechanical stop. The piston 202 (FIG. 2) has hit center rod stop 210, and begin moving the center feed rod 206 and attached pilot spool 212 to the right in FIG. 14, beginning the end of retract mode. At this point, however, the retract port 408 is still open and the piston 202 still retracting.

Figure 15:
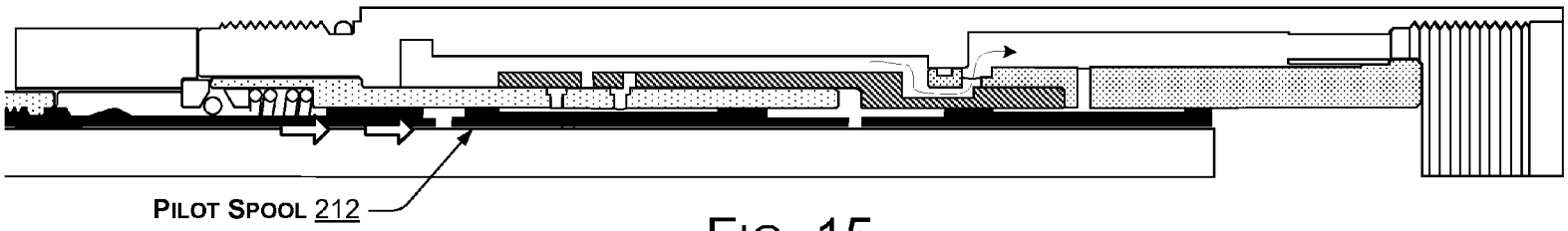
Figure 16:
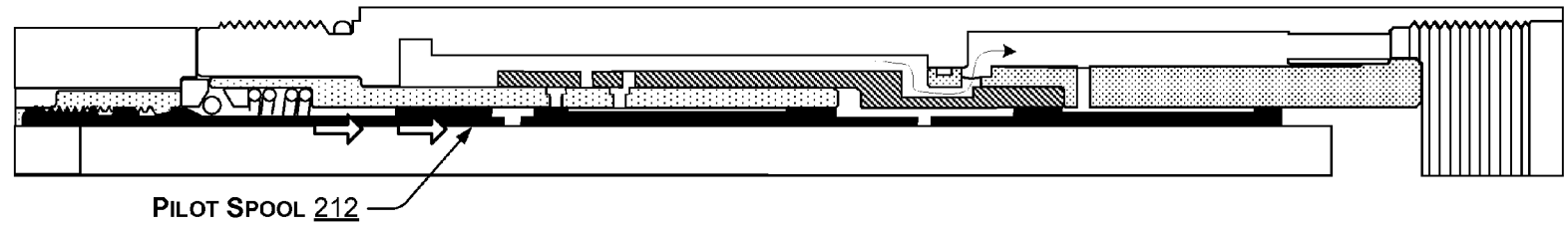

FIGS. 15-16 shows continued movement of the pilot spool 212 at the end of retract mode. The pilot spool is getting close to the position at which the pilot spool 212 will trigger a change in the valve's porting state.

Figure 17:
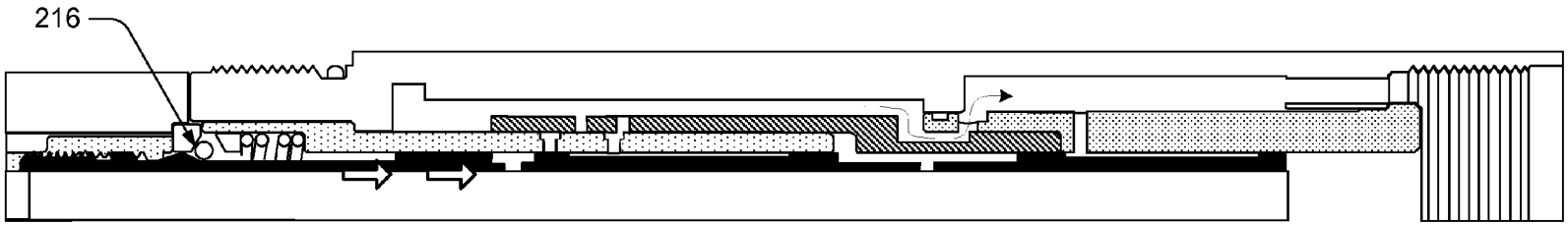

FIG. 17 shows a cam on the pilot spool beginning to engage the détente 216 at the end of retract mode.

Figure 18:
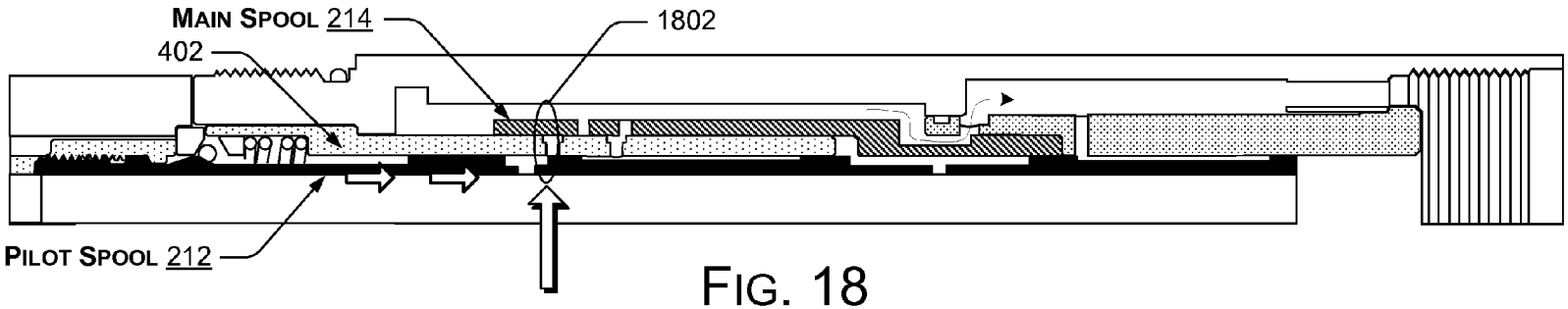

FIG. 18 shows an alignment 1802 of the pilot spool 212 and the extend cartridge 402 at which the hydraulic path of the extend port 406 begins to crack open. However, the hydraulic path is still closed between the extend cartridge 402 and the main spool 214, as the main spool has not transitioned to a next porting state yet.

Figure 19:
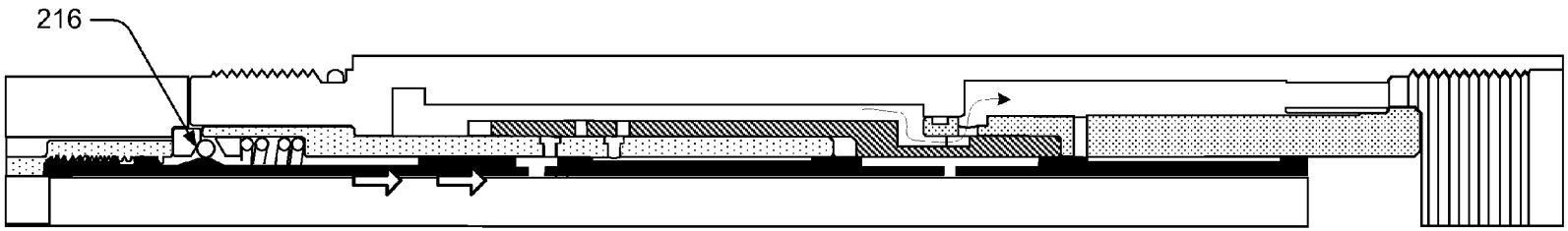

FIG. 19 shows a top dead center position of the détente cam on the pilot spool 212 with the détente 216.

Figure 20:
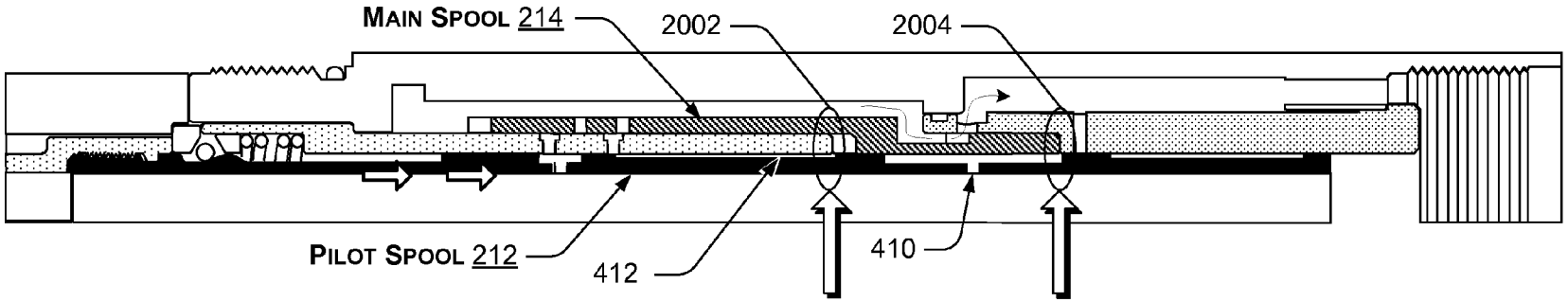

FIG. 20 shows an alignment 2002 of the pilot spool 212 and the extend cartridge 402 at which the bottom main spool vent 412 first cracks open and an alignment 2004 of the pilot spool 212 and the main spool 214 at which the hydraulic fluid from the main spool control port 410 first has access to a side of the main spool 214 for snapping the main spool 214 into an extend porting state.

Figure 21:
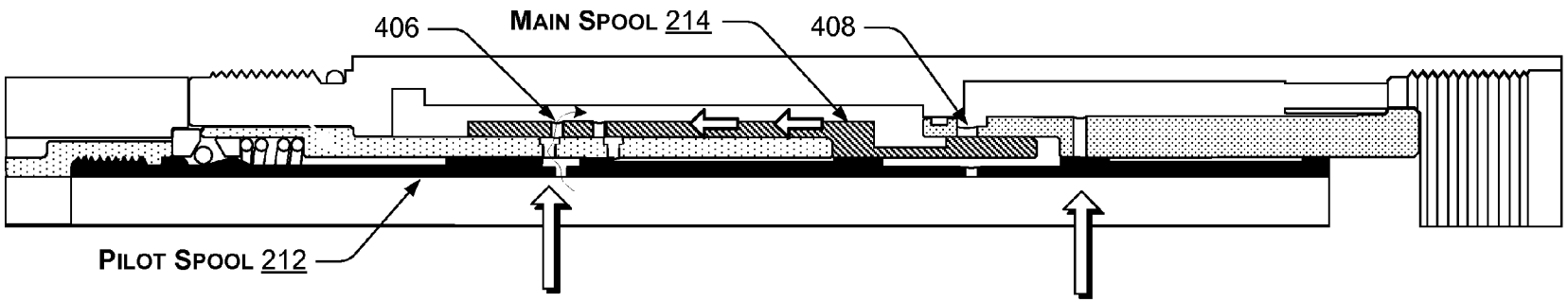

FIG. 21 shows a state change of the main spool 214 as it has been forced to the left in FIG. 21 into extend mode. The extend port 406 is now open. The retract port 408 is now closed. The valve 100 is now back in the same state shown in FIG. 5, and has completed a full valve cycle.

Figure 22:
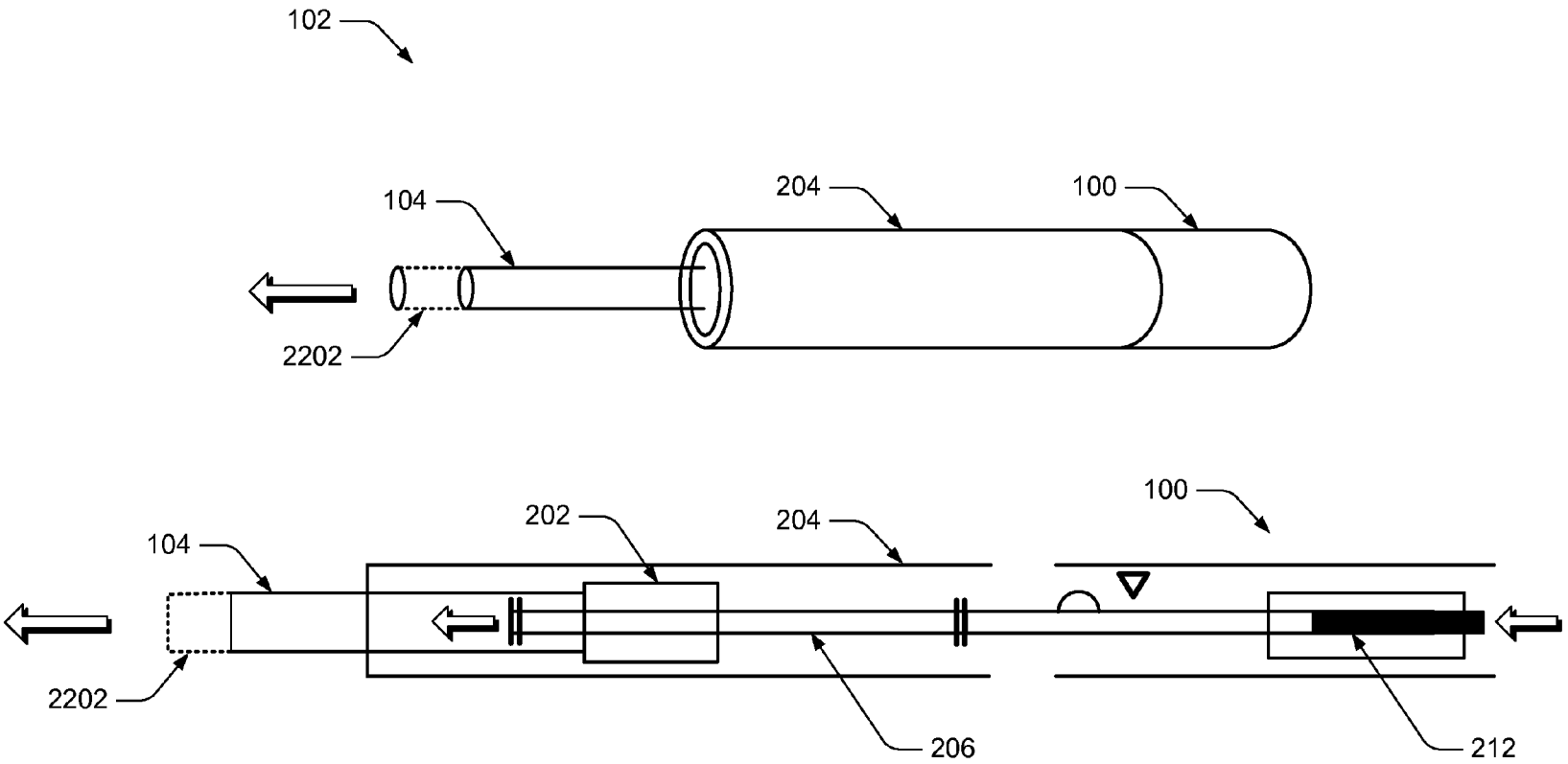
FIG. 22 is a diagram of a hyperextension mode of an example two-step hydraulic valve.

FIG. 22 shows a hyperextend mode of the two-step hydraulic valve 100. In an implementation, the hyperextend mode takes advantage of a protracted retraction mode, when the pilot spool 212 is coasting during overtravel. But if the return hydraulic line is shut, then instead of retracting the piston rod assembly 104, the piston 202 travels to its hydraulic extend limit. Because the return path is closed, the pressure on the top of the piston 202 does not drop so the piston rod assembly 104 does not retract. The piston 202 overextends its normal extend stroke, instead of retracting. The valve 100 causes the piston 202 to change stroke directions by applying a hydraulic stop and reversal, so there is no mechanical stop at the piston position where the piston 202 changes from extend mode to retract mode. This also eliminates mechanical stress. The piston 202 is free to extend further 2202 than its usual extend stroke, when the hydraulic porting accommodates this action. The overtravel feature of the pilot spool 212 during retract mode can provide the porting to support hyperextension of the rod 104 from the hydraulic actuator 102 if a technique or hardware for closing the hydraulic return line is provided.

The hyperextension of the piston rod 104 can be useful for various functions, such as flushing out the working fluid in the diaphragm 110 of a diaphragm pump, opening a valve, flushing the system of particulates, or for other purposes. Once provision is made for the hydraulic return line to be closed at the appropriate time during the valve cycle, the piston rod can be made to extend past the normal hydraulic limit.

EXAMPLE METHODS

Figure 23:
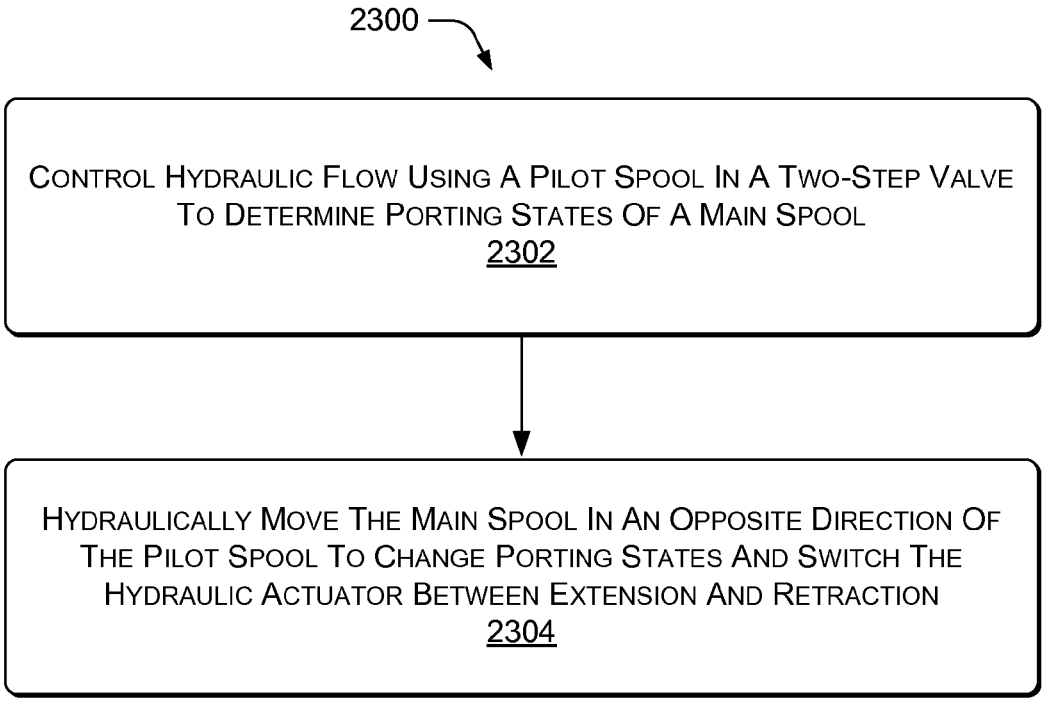
FIG. 23 is a flow diagram of an example method of controlling a hydraulic actuator with an example two-step hydraulic valve with retrograde spool action.

FIG. 23 shows an example method 2300 of reciprocating a hydraulic actuator. In the flow diagram, the operations are summarized in individual blocks.

At block 2302, a pilot spool in a two-step valve controls hydraulic flow to determine porting states of a main spool.

At block 2304, the main spool hydraulically moves in an opposite direction of the pilot spool to change porting states and switch the hydraulic actuator between extension and retraction.

Figure 24:
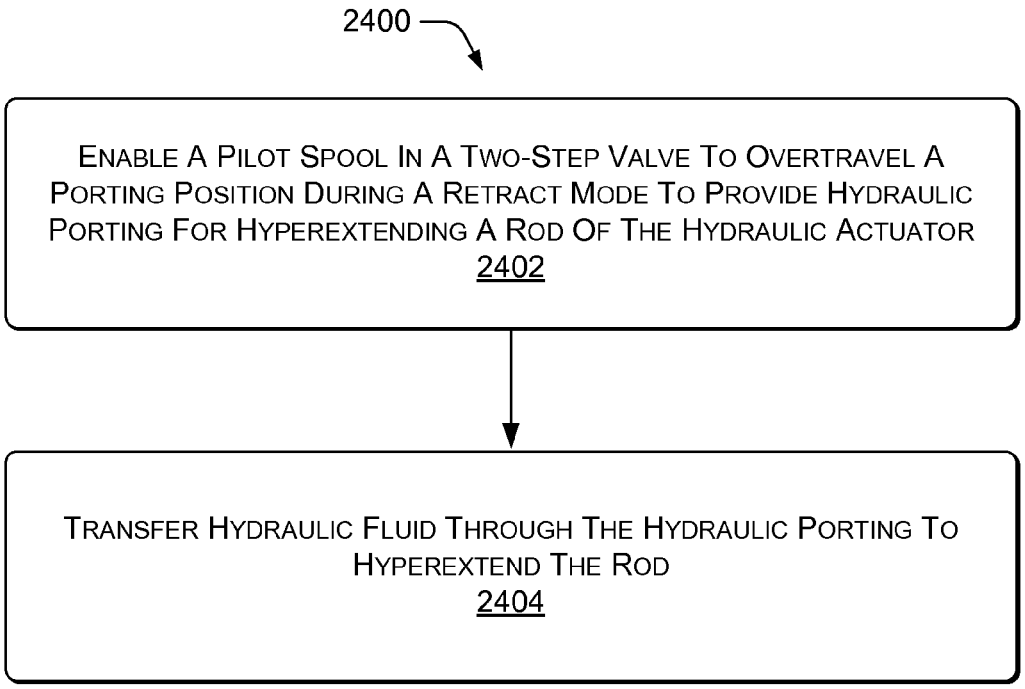
FIG. 24 is a flow diagram of an example method of hyperextending a hydraulic actuator using an example two-step hydraulic valve.

FIG. 24 shows an example method 2400 of hyperextending a hydraulic actuator. In the flow diagram, the operations are summarized in individual blocks.

At block 2402, a pilot spool in a two-way valve is allowed to overtravel a position during a retract mode to provide hydraulic porting for hyperextending a rod of the hydraulic actuator.

At block 2404, hydraulic fluid is transferred though the hydraulic porting to hyperextend the rod.

CONCLUSION

Although only a few example embodiments have been described in detail above, those skilled in the art will readily appreciate that many modifications are possible in the example embodiments without materially departing from the subject matter of two-step hydraulic valves. Accordingly, all such modifications are intended to be included within the scope of this disclosure as defined in the following claims. In the claims, means-plus-function clauses are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

The invention claimed is:

1. An apparatus, comprising:

a valve for switching a direction of travel of a piston in a hydraulic cylinder;

a main spool movable in the valve for directing a hydraulic fluid to either a first side or a second side of the piston wherein the main spool comprises an axial bore having an axis that defines axial directions of travel of the main spool; and a pilot spool that comprises an axial bore having an axis that defines axial directions of travel of the pilot spool wherein the pilot spool is movable at least in part in the axial bore of the main spool to direct the hydraulic fluid for hydraulic switching that comprises moving the main spool under positive hydraulic pressure in one of the axial directions of travel of the main spool simultaneous with and opposite to moving of the pilot spool in one of the axial directions of travel of the pilot spool during at least part of a reciprocating cycle of the valve.

2. The apparatus of claim 1, wherein only the hydraulic fluid moves the main spool.

3. The apparatus of claim 1, wherein each moving of the main spool back-and-forth between a first porting position of the main spool and a second porting position of the main spool is actuated by hydraulic fluid without using a momentum of the main spool to change porting positions or to assist changing porting positions.

4. The apparatus of claim 1, wherein when the pilot spool ports hydraulic fluid for moving the main spool to a next porting position, and wherein the hydraulic fluid secures the main spool in the next porting position under force of hydraulic pressure.

5. The apparatus of claim 4, further comprising:

a reciprocating pump connected via a piston rod to the piston;

a center feed rod to direct the hydraulic fluid to the second side of the piston;

a détente to secure the pilot spool in either a first discrete porting position of the pilot spool or a second discrete porting position of the pilot spool; and wherein when a motion of the piston via the center feed rod moves the pilot spool in a movement direction from one of the porting positions of the pilot spool to a subsequent porting position of the pilot spool, the hydraulic fluid enabled by the subsequent porting position of the pilot spool moves the main spool to a subsequent porting position of the main spool in a retrograde direction from the movement direction of the pilot spool.

6. The apparatus of claim 5, wherein an extension of the piston rod from the hydraulic cylinder is actuated by one of the porting positions of the main spool, and a retraction of the piston rod is actuated by the other porting position of the main spool; and wherein when the main spool moves to a subsequent porting position, the subsequent porting position directs the hydraulic fluid to change a direction of travel of the piston rod.

7. The apparatus of claim 5, wherein the reciprocating pump comprises a diaphragm pump.

8. The apparatus of claim 5, wherein when the main spool moves to the next porting position, the hydraulic fluid ported by the main spool applies a hydraulic stop to the piston to eliminate a need for a mechanical stop for the piston.

9. The apparatus of claim 5, wherein the flow of the hydraulic fluid at the porting positions of the pilot spool and the porting positions of the main spool prevent a possibility of the valve hydraulically locking.

10. The apparatus of claim 5, wherein the pilot spool travels sufficiently during a retract mode to provide porting to hyperextend the piston rod.

11. A reciprocating hydraulic actuator, comprising:

a hydraulic cylinder;

a rod extendable from the hydraulic cylinder and retractable into the hydraulic cylinder;

a two-step valve to extend and retract the rod;

a retrograde spool that comprises an axial bore having an axis that defines axial directions of travel of the retrograde spool;

a pilot spool that comprises an axial bore having an axis that defines axial directions of travel of the pilot spool wherein the pilot spool is disposed at least in part in the axial bore of the retrograde spool, wherein the pilot spool comprises ports to apply a hydraulic force to move the retrograde spool to an extension porting state or a retraction porting state and wherein the retrograde spool comprises ports and moves in one of the axial directions of travel of the retrograde spool simultaneous with and opposite to the pilot spool moving in one of the axial directions of travel of the pilot spool when hydraulically switching the rod between extension and retraction.

12. The reciprocating hydraulic actuator of claim 11, wherein hydraulic force moves the retrograde spool in a retrograde motion into a next porting state and secures the retrograde spool in the next porting state with the applied hydraulic force.

13. The reciprocating hydraulic actuator of claim 11, wherein the pilot spool travels sufficiently during a retract mode to provide porting to hyperextend the rod; and further comprising means to alter a hydraulic circuit connected to the reciprocating hydraulic actuator to hyperextend the rod responsive to an axial position of the pilot spool.

14. The reciprocating hydraulic actuator of claim 11, wherein the ports of the pilot spool and the ports of the retrograde spool are placed to prevent hydraulic locking of the valve during an operating cycle of the reciprocating hydraulic actuator.

15. A submersible reciprocating pump, comprising:

a pump module to alternately input and output a fluid when actuated;

a hydraulic cylinder to actuate the pump module including a rod extendible from the hydraulic cylinder and retractable into the hydraulic cylinder;

a valve to extend and retract the rod;

a main spool that comprises an axial bore having an axis that defines axial directions of travel of the main spool; and a pilot spool that comprises an axial bore having an axis that defines axial directions of travel of the pilot spool wherein the pilot spool is disposed at least in part in the axial bore of the main spool to hydraulically drive the main spool wherein the main spool is hydraulically movable to porting states and movable under positive hydraulic pressure in one of the axial directions of travel of the main spool simultaneous with and retrograde to moving of the pilot spool in one of the axial directions of travel of the pilot spool during at least part of a reciprocating cycle of the valve.

16. The submersible reciprocating pump of claim 15, wherein the pump module comprises a diaphragm pump.

17. The submersible reciprocating pump of claim 15, wherein the main spool applies hydraulic stops to an extension stroke of the rod and to a retraction stroke of the rod, eliminating mechanical stops for the rod.

18. The submersible reciprocating pump of claim 17, further comprising means for reversing hydraulic feed lines to the submersible reciprocating pump to hyperextend the rod from the hydraulic cylinder when the pilot spool provides porting to hyperextend the rod during a retract mode.

* * * * *